United States Patent [19]

Hennessey

[11] Patent Number: 4,658,693

[45] Date of Patent: Apr. 21, 1987

[54] REAR OPERATED CONTROL DEVICE FOR GUITAR

[75] Inventor: James R. Hennessey, West Hartford, Conn.

[73] Assignee: The Music People, Inc., Hartford, Conn.

[21] Appl. No.: 856,838

[22] Filed: Apr. 25, 1986

[51] Int. Cl.[4] ..... G10D 3/00

[52] U.S. Cl. ..... 84/313; 84/312 R

[58] Field of Search ..... 84/267, 298, 299, 312 R, 84/313

[56] References Cited

U.S. PATENT DOCUMENTS

| | | | |
|---|---|---|---|
| 2,136,627 | 11/1938 | Lohman | 84/313 |
| 2,889,732 | 9/1959 | Juricek | 84/312 P |
| 3,185,011 | 5/1965 | Anderson | 84/313 |
| 3,382,749 | 5/1968 | Watson | 84/313 |
| 3,512,443 | 5/1970 | Parson et al. | 84/313 |
| 3,686,993 | 8/1972 | Fender | 84/312 R |
| 3,910,152 | 10/1975 | Kusakawa | 84/307 |
| 4,044,645 | 8/1977 | Franzmann | 84/313 |
| 4,126,074 | 11/1978 | Lundquist | 84/313 |
| 4,137,812 | 2/1979 | Franzmann | 84/313 |
| 4,343,220 | 9/1982 | Lundquist | 84/313 |
| 4,354,417 | 10/1982 | Glaser, II | 84/312 R |
| 4,397,212 | 8/1983 | Carson | 84/313 |
| 4,535,670 | 8/1985 | Borisoff | 84/312 R |

FOREIGN PATENT DOCUMENTS

| | | | |
|---|---|---|---|
| 56-153997 | 11/1981 | Japan | 84/313 |
| 57-115094 | 7/1982 | Japan | 84/313 |
| 58-88694 | 6/1983 | Japan | 84/313 |
| 58-138989 | 9/1983 | Japan | 84/313 |
| 59-66288 | 5/1984 | Japan | 84/313 |
| 59-171756 | 11/1984 | Japan . | |

*Primary Examiner*—Lawrence R. Franklin

[57] ABSTRACT

Apparatus enabling dynamic variation of string pitch in a guitar utilizes an operating arm that is rotatably attached to the inner end of the pivotable bridge block, and is disposed at the rear of the instrument.

12 Claims, 8 Drawing Figures

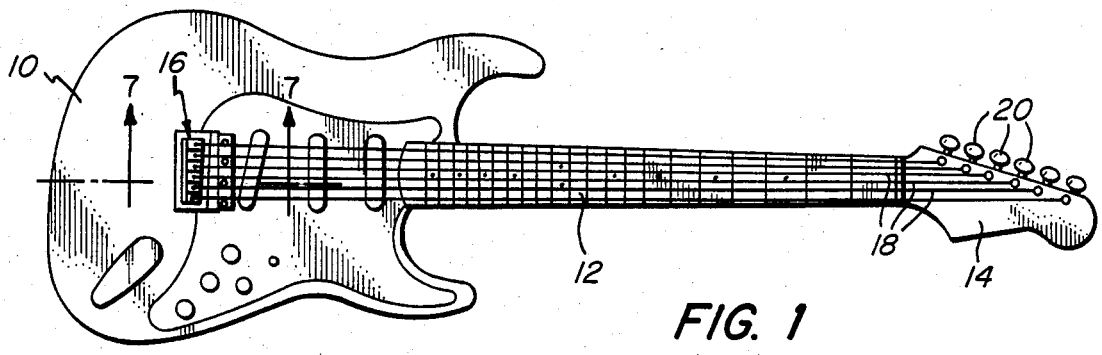
FIG. 1
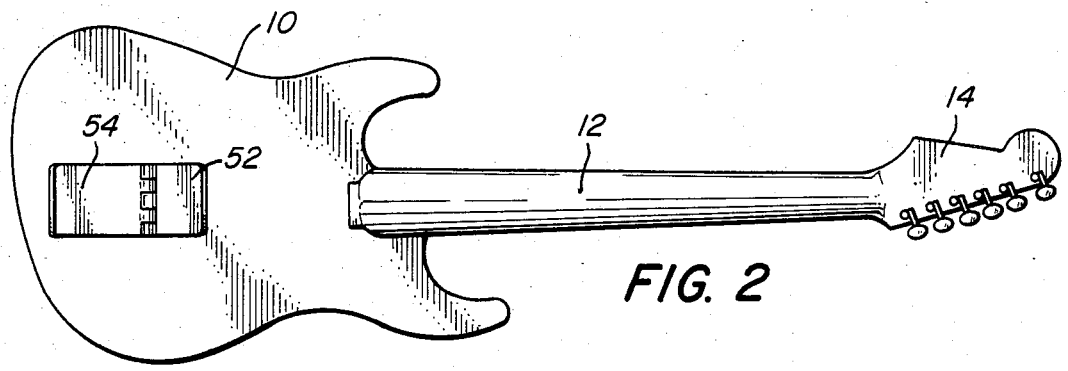
FIG. 2
FIG. 3
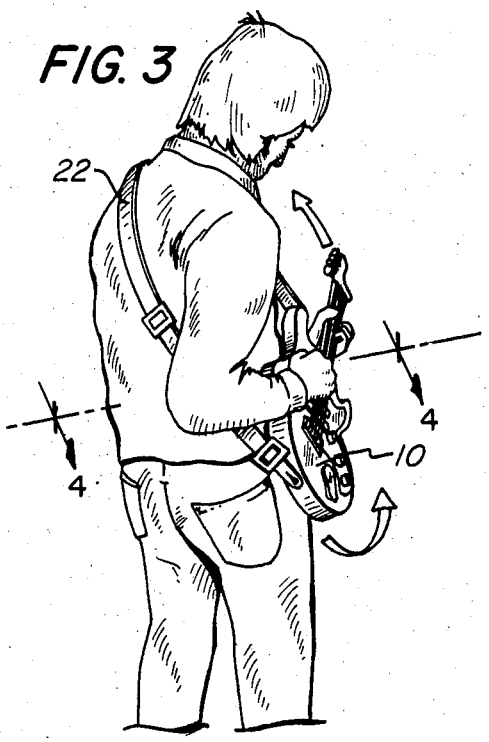
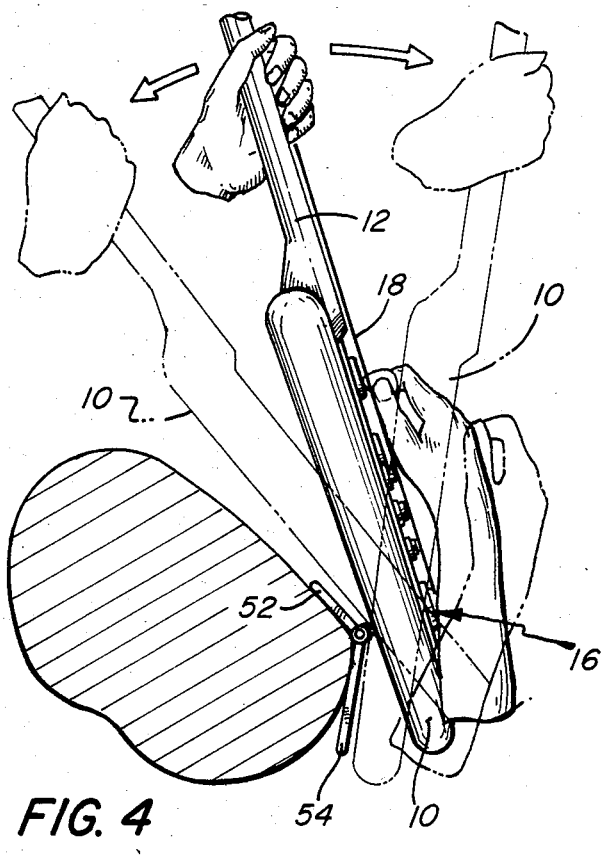
FIG. 4

REAR OPERATED CONTROL DEVICE FOR GUITAR

BACKGROUND OF THE INVENTION

Electric guitars are often fitted with mechanisms for dynamically changing the tension upon one or more of the sound-producing strings, so as to vary the pitch. By using such a mechanism to alternatively increase and relax tension on the strings, a so-called "tremolo" effect can be produced; reducing the tension from the as-tuned condition results in what is known as a "choking" effect; "note bending" and "detuning" effects can be produced as well with mechanisms of this type.

In their most conventional form, tremolo devices employ a lever which is connected to the bridge block and is disposed on the front of the instrument body near its tail or bottom end; thus, it is positioned for oscillation by the player using his picking and strumming hand. To produce the desired effect, the performer must therefore first play a note or chord and then move his hand to operate the tremolo lever; obviously, he cannot do both at the same time.

Variations in the means for operating pitch varying mechanisms of this type have been proposed in the art. For example, in Glaser, II U.S. Pat. No. 4,354,417, a tone changer unit is disclosed wherein individual strings may be attached to one of three lever arms to enable alteration of their pitch. An extension arm is non-rotatably connected to one of the three lever arms, and is designed to be operated by engagement with the performer's body. The unit is located at the top of the instrument body near the neck junction, and cables are employed to transmit movement of the operating lever assembly to the bridge assembly, and thereby to the strings of the instrument.

A note bender attachment is shown in Borisoff U.S. Pat. No. 4,535,670, which is actuated by body movement through contact with an arm that extends rearwardly from the tail end of the instrument. The actuating arm is evidently disposed to lie alongside of the player's hip when the instrument is held in playing position.

Other U.S. patents show pitch changing devices for stringed instruments which are actuated in various ways. Thus, Lohman U.S. Pat. No. 2,136,627 uses an electrical motor to vibrate the bridge of a guitar, and U.S. Pat. No. 3,382,749 to Watson discloses the similar use of a pneumatic diaphragm. A pedal-operated tuning control arrangement, which is connected from the rear of the instrument, is shown in Jurichek U.S. Pat. No. 2,889,732, and strap-control mechanisms are disclosed both in Parson et al U.S. Pat. No. 3,512,443 and in Fender U.S. Pat. No. 3,686,993.

Kusakawa U.S. Pat. No. 3,910,152 provides a sliding bridge for a stringed instrument, the position of which may be adjusted by pedals connected through the rear of the body. Lundquist U.S. Pat. No. 4,343,220 utilizes the chin rest of a violin, or a chest or hand-operated plunger arrangement, to produce vibrato by oscillation of the bridge, and an external frame is described by Carson in U.S. Pat. No. 4,397,212 for producing vibrato and pitch control in a guitar.

Although the prior art therefore discloses different forms of hand-held stringed musical instruments having dynamic pitch changing mechanisms, which are operated by movement of the instrument relative to the player's body, still the arrangements disclosed are not optimal. The performing styles of modern guitarists are often typified by wide-ranging and vigorous movement, and are inhibited to the extent that such action is dictated by the need to maintain the operating member of a pitch-controlling mechanism for the instrument in a certain position. The musical, as well as the visual, quality of the performance may be significantly affected as a result.

Accordingly, it is a broad object of the present invention to provide a novel apparatus for dynamic pitch variation in a hand-held stringed musical instrument, and to provide a novel instrument incorporating such apparatus, which permits the performer to effectively control the character of the sound produced, while at the same time affording him a wide range of movement.

A more specific object of the invention is to provide such an apparatus and musical instrument wherein the operating member for the apparatus has a portion that is adapted to stably seat upon a body part of the performer, and to remain in place thereupon despite considerable movement of the instrument, and which thereby affords a high degree of control of the sound produced, throughout a wide range of instrument positions.

It is also an object of the invention to provide an apparatus and instrument having the foregoing features and advantages in which the pitch-varying apparatus can be used alternatively for both increasing and decreasing string tension, is relatively uncomplicated and inexpensive to manufacture, and is adapted for facile installation on the instrument both as original equipment and also as an add-on feature.

SUMMARY OF THE INVENTION

It has now been found that certain of the foregoing and related objects of the invention are readily attained by the provision of apparatus comprised of a bridge block adapted for mounting upon the body of a hand-held stringed musical instrument, to extend transversely thereof and for pivotal movement about a first axis thereon. The block has an outer portion, with means for attachment of at least one string of the instrument so that the string extends therefrom along a second axis generally transverse to the first, and an operating arm is provided which is adapted to conform generally to the contours of the human body trunk. Mounting means operatively attaches the operating arm to an inner portion of the bridge block; it permits subtantially free relative rotational movement of the arm about an axis that is generally perpendicular to both the "first" and the "second" axes, while so constraining the arm and block against relative movement as to permit pivoting of the block by the arm about the "first" axis. Consequently, with the bridge block mounted upon the body of an instrument as described, and with the operating arm disposed along its rear face, the arm may be shifted with respect to the instrument body by movement of the instrument relative to the player's body, in turn causing the bridge block to pivot about the "first" axis to thereby change the tension in the attached string.

In the preferred embodiments of the apparatus, the bridge block will be dimensioned to extend through the instrument body, and the mounting means will comprise a swivel post extending into the inner portion of the bridge block substantially along a transverse axis between its inner and outer portions. Normally, the bridge block will be elongated in the direction of extension of the "first" axis, and the attachment means will be adapted to affix a plurality of strings at spaced locations along the length of the block, the rotational axis of the mounting means for the operating arm being disposed substantially intermediate the outermost two of the spaced locations. Most desirably, the operating arm will be comprised of a pair of oppositely extending components, and will have means for varying the positions of the components to optimize conformity of the arm to the body trunk part. The arm components will advantageously be in the form of substantially planar, hinged panels, with the position-varying means being adapted to set them in a multiplicity of angular positions.

Other objects of the invention are attained by the provision of a stringed musical instrument, and in particular an electric guitar, comprised of the usual parts and including a pivotable bridge block. The latter has mounting means and an operating arm thereon, both of which are constructed and arranged as hereinabove described.

BRIEF DESCRIPTION OF THE DRAWINGS

FIG. 1 is a front view of an electric guitar embodying the present invention, having a dynamic pitch control device incorporated thereinto;

FIG. 2 is a rear view of the guitar;

FIG. 3 is a perspective view showing the instrument held by a performer in position for playing;

FIG. 4 is a sectional view, taken along line 4—4 of FIG. 3 and drawn to an enlarged scale, showing in full and phantom line three different positions of the instrument, with respect to the player's body, by which pitch changes are produced by operation of the incorporated device;

DETAILED DESCRIPTION OF THE ILLUSTRATED EMBODIMENT

Figure 5:
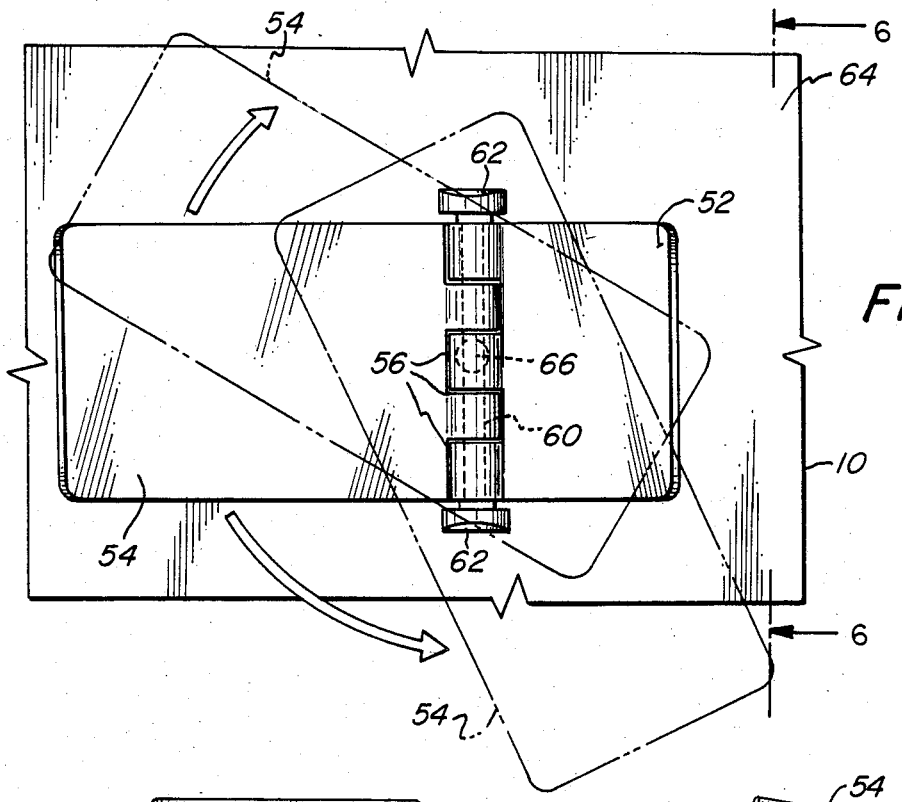
FIG. 5 is a fragmentary rear view of the instrument of FIGS. 1 and 2, drawn to an enlarged scale and showing, in full and phantom line, different rotational position of the operating arm of the pitch variation device.
Figure 6:
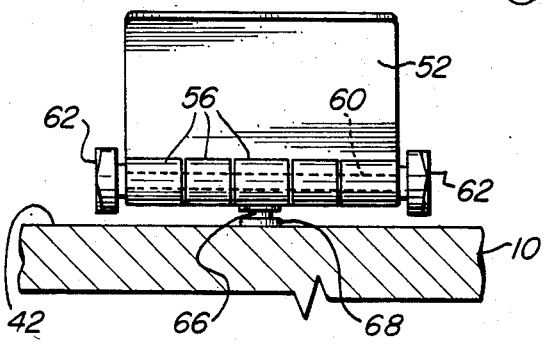
FIG. 6 is a fragmentary end view of the instrument, taken along line 6—6 of FIG. 5.

Turning now in detail to FIGS. 1–4 of the appended drawings, therein illustrated is an electric guitar embodying the present invention, and including a body 10 and a neck 12, the neck being attached at one end to the body 10 and having a head portion 14 at its opposite end; a bridge block, generally designated by the numeral 16, is mounted within the body 10. The instrument is strung with six strings 18, the upper ends of which are attached to standard tuning pegs 20 mounted within the head portion 14, the lower ends being affixed to the bridge block 16 in conventional fashion. A strap 22 may be attached to the body 10 to support the guitar over the shoulder of the performer, as shown in FIG. 3.

Figure 7:
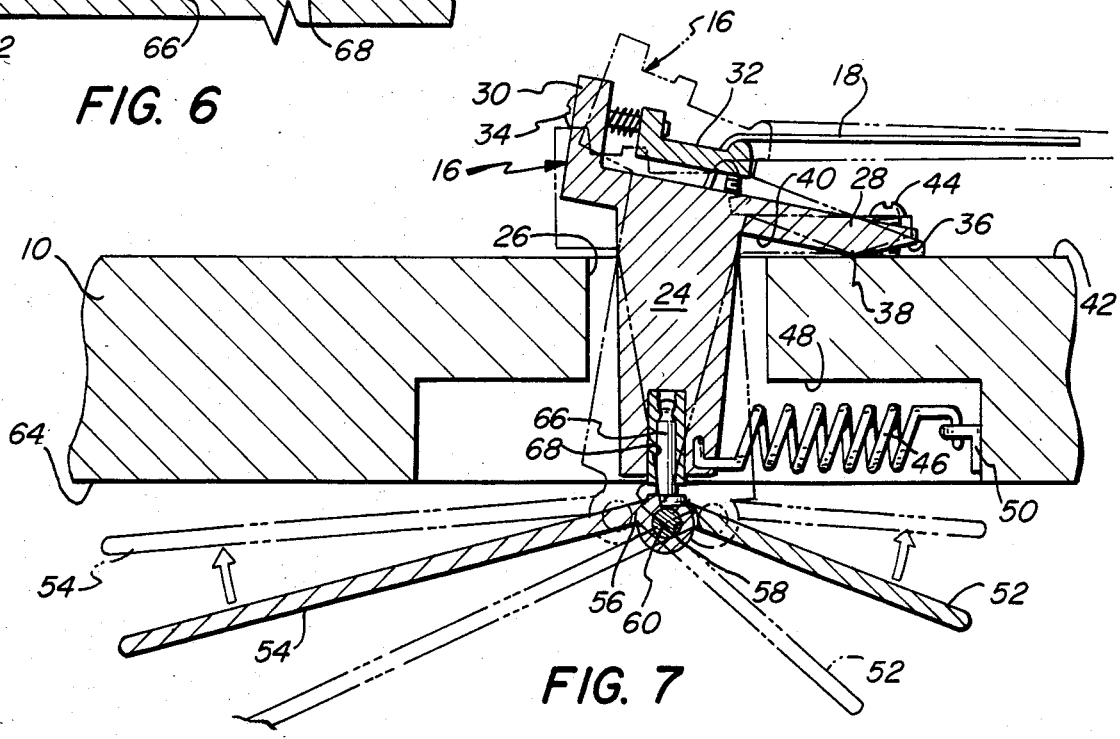
FIG. 7 is a fragmentary sectional view of the instrument, taken along line 7—7 of FIG. 1 and drawn to a scale enlarged therefrom, the Figure showing details of construction of the pitch variation apparatus and also showing, in full line, tremolo and choke positions thereof.

The bridge block 16 is illustrated in most detail in FIG. 7, and includes a body portion 24 having a depth dimension sufficient to cause the block to extend transversely through the body 10, an opening 26 being formed therethrough to accommodate the body portion 24. A slotted plate portion 28 is formed at the top of the bridge body 24 and extends toward the head end of the instrument, and an L-shaped flange portion 30 is provided to the opposite (tail end) side. As will be appreciated, the bridge block is of a width sufficient to enable attachment of the full complement of six strings, and the plate and flange portions 28, 30 are coextensive therewith. The strings 18 are secured by block elements 32, each of which is in turn affixed to the flange portion 30 by a screw 34 to permit fine tuning.

The bottom of the plate portion 28 has a bevelled forward edge element 36, which forms a ridge-like fulcrum 38 extending across the block 16 along the juncture with the rearward surface element 40. This of course permits the bridge block 16 to pivot upon the front face 42 of the instrument body 10 about an axis that is transverse to the longitudinal axis of the instrument along which the strings 18 extend. The screw 44 is received within a slot (not seen), which opens along the forward edge of the plate portion 28 and prevents displacement of the bridge block against the force of the strings 18; at the same time, it permits pivotal movement thereof along the ridge-like fulcrum 38. A set of coil springs 46 (only one of which is visible) exert a bias on the block 18 to counteract the tension on the strings, the opening 26 being enlarged at 48 to accommodate them. One end of each spring 46 is secured to the block body portion 24 and the opposite ends are affixed to the instrument body 10 by a bracket 50 mounted within the opening section 48. As will be appreciated, the foregoing are all conventional features of bridge assemblies adapted for use in tremolo devices.

The unique operating arm of the pitch control apparatus provided is comprised of a pair of panel-like components 52, 54, which are hinged together by interdigitated knuckle elements 56; the knuckle elements define circular openings which are aligned to cooperatively provide a common passageway 58 in assembly. A shaft 60 extends through the passageway 58 to hingedly join the arm components 52, 54, and it has a pair of push-button elements 62 mounted upon its opposite ends.

Figure 8:
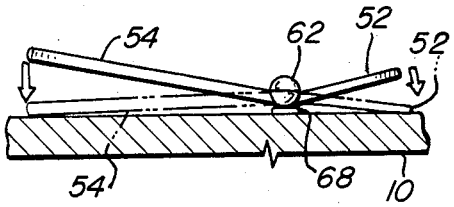
FIG. 8 is a fragmentary side view showing, in full line, the components of the operating arm in position for use, and showing in phantom line a collapsed relationship in which they may be disposed for storage purposes.

The elements 62 engage internal structure (not shown) of the knuckle elements 56 to independently lock each of the components 52, 54 in a range of angular positions pivoted about the shaft 60. In this manner, the effective configuration of the operating arm can be modified by adjustment of the positions of the components 52, 54, both with respect to one another and also with respect to the body of the instrument, so as to optimize conformity to the body part of the person playing the instrument. As seen in FIG. 8, the arrangement also permits lowering of the components to positions against the rear face 64 of the guitar body 10, for storage purposes; although not shown, the rear surface of the instrument body will desirably be formed with a recess shaped to correspond to the collapsed components 52, 54, to permit them to be stored out of the way when not in use.

Although the details of the mechanism used for locking the components of the operating arm in their various positions are also not illustrated, suitable mechanical means will be evident to those skilled in the art. For example, the inner ends of the push-button elements 62 may be formed to provide a series of longitudinal ridges and grooves thereabout, which cooperate, when extended outwardly, with mating ridges and grooves formed into the inner surfaces of the knuckel elements 56 within which they are mounted. Inward displacement of either element 62 would disengage the mating parts, and thereby permit movement of the corresponding arm component to an alternative position. As other possibilities, suitable ratchet, and selectively locking dog arrangements, can be used.

A short post 66 projects perpendicularly from the middle of the shaft 60, and has its outer end rotatably engaged within a bushing 68, which is in turn affixed within the inner end of the bridge block body portion 24. By this arrangement, the assembly of arm components 52, 54 and shaft 60 can rotate on the bridge block 16 about a transverse axis between its inner and outer portions. At the same time, the post 66 provides a rigid interconnection on that axis, so that pivoting of the bridge block about the fulcrum 38 can be effected by the application of force upon either of the components 52, 54 of the operating arm.

As best seen in FIGS. 3 and 4, when the guitar is in playing position the operating arm assembly will normally be seated upon the player's hip, the components 52, 54 being disposed relative to one another to optimize conformity to the hip area and to thereby minimize the likelihood that the operating arm will move out of position. Moving the instrument counterclockwise in FIG. 4 (to bring its body 10 closer to the performer) will of course apply force to the shorter arm component 52, causing the bridge block 16 to pivot, also in the counterclockwise direction as shown in FIG. 7, thereby increasing tension upon the strings 18 and raising their pitch; rapid relative movement to apply intermittent pressure upon the component 52 will produce a tremolo effect. Alternatively, moving the instrument away (i.e., clockwise in FIG. 4) will apply force to the longer arm component 54, thereby reducing tension upon the strings and producing a choking effect.

Because of the secure seating of the operating arm upon the body part of the player, movement of the instrument upwardly and downwardly (as suggested by the arrows in FIG. 3) will cause no loss of control over the pitch changing mechanism. Thus, the performer can move the instrument through a wide range of positions, in a highly active and free-style manner, to permit him great latitude in visual effect without sacrifice of musical quality. Furthermore, such relative movement can be used selectively to either increase or decrease string tension, thereby enabling a wide variety of musical effects to be produced.

Thus, it can be seen that the present invention provides a novel apparatus for dynamic pitch variation in a hand-held stringed musical instrument, and provides a novel instrument incorporating such apparatus. It permits the performer to exercise close control over the sound produced while, at the same time, affording wide latitude and range of movement of the instrument for optimal musical and visual effect. The operating member employed is adapted to stably seat upon a body part of the performer and to remain in place despite considerable movement of the instrument; the apparatus is relatively uncomplicated and inexpensive to produce, and it is relatively facile to install on the instrument, both as original equipment and also as an add-on device.

Having thus described the invention, what is claimed is:

1. Apparatus for enabling dynamic variation of string pitch in an electric guitar, or like hand-held stringed musical instrument, comprising:

a bridge block adapted for mounting to extend transversely of the body of a musical instrument and for pivotal movement about a first axis, said block having an outer portion with means thereon for attachment of at least one string of the instrument, to extend therefrom along a second axis generally transverse to said first axis;

an operating arm adapted to conform generally to contours of the human body trunk; and mounting means operatively attaching said operating arm to an inner portion of said block for substantially free relative rotational movement thereon about an axis of said mounting means that is generally perpendicular to both of said first and second axes, and so constraining said arm and block against relative movement as to permit pivoting of said block about said first axis by movement of said arm; whereby, with said bridge block so mounted upon the body of an instrument, with said operating arm disposed along the rear face thereof, and with the instrument in playing position and said arm engaging a trunk part, the player may produce string pitch variation by moving his body and that of the instrument relative to one another, thereby shifting said arm relative to the instrument body and causing said bridge block to pivot about said first axis to change the tension in a string attached thereto, said mounting means permitting said arm to remain substantially in place on the body part despite rotational movement of said instrument about said mounting means axis.

2. The apparatus of claim 1 wherein said bridge block is dimensioned to extend through the instrument body, and wherein said mounting means comprises a swivel post extending into said inner portion of said block substantially along a transverse axis between said inner and outer portions thereof.

3. The apparatus of claim 1 wherein said bridge block is elongated in the direction of extension of said first axis, wherein said attachment means is adapted to attach a plurality of strings at spaced locations along the length of said block, and wherein said rotational axis of said mounting means is disposed substantially intermediate the outermost two of said spaced locations.

4. The apparatus of claim 1 wherein said operating arm is comprised of a pair of oppositely extending components, said arms having means for varying the positions of said components to optimize conformity to the body trunk part.

5. The apparatus of claim 4 wherein said arm components are hinged to one another, and wherein said position-varying means is adapted to affix said components in a multiplicity of relative angular positions.

6. The apparatus of claim 5 wherein said arm components are in the form of substantially planar panels.

7. A stringed musical instrument, such as an electric guitar, capable of dynamic variation of string pitch, comprising:

a musical instrument body having front and rear faces, and adapted for attachment of the upper ends of a multiplicity of sound-producing strings to extend parallel to a longitudinal axis of said body and over said front face thereof;

bridge means on said body having means thereon for attaching the lower ends of the strings, said bridge means including a block mounted for pivotal movement about a first axis transverse to said longitudinal axis and having means thereon for attaching the lower end of at least one string;

an operating arm adapted to conform generally to contours of the human body trunk; and mounting means operatively attaching said operating arm to said block and disposing said arm along said rear face of said instrument body, said mounting means so constraining said arm and block against relative movement as to permit pivoting of said block about said first axis by shifting said arm with respect to said instrument body, and permitting substantially free rotational movement between said arm and said block; whereby, with said instrument in playing position and said lever engaging a trunk part, the player may produce string pitch variation by relative movement of his body and said instrument so as to shift said arm and thereby cause said bridge block to pivot about said first axis to change the tension in a string attached thereto, said mounting means permitting said arm to remain substantially in place on the body part despite rotational movement of said instrument relative thereto about an axis between said arm and said bridge block.

8. The instrument of claim 7 wherein said bridge block extends through said instrument body and has an outer portion disposed substantially on said front face thereof and an inner portion disposed substantially on said rear face thereof, and wherein said mounting means comprises a swivel post extending into said inner portion substantially along a transverse axis of said block between said inner and outer portions thereof and providing said axis of rotational movement.

9. The instrument of claim 7 wherein said bridge block is elongated in the direction of extension of said first axis, wherein said attachment means is adapted to attach a plurality of strings at spaced locations along the length of said block, and wherein said rotational axis of said mounting means is disposed substantially intermediate the outermost two of said spaced locations.

10. The instrument of claim 7 wherein said operating arm is comprised of a pair of oppositely extending components, said arm having means for varying the positions of said components to optimize conformity to the body trunk part.

11. The instrument of claim 10 wherein said arm components are hinged to one another, and wherein said position-varying means is adapted to affix said components in a multiplicity of relative angular positions.

12. The instrument of claim 11 wherein said arm components are in the form of substantially planar panels.

* * * * *